US006252347B1

(12) United States Patent
Breen et al.

(10) Patent No.: US 6,252,347 B1
(45) Date of Patent: Jun. 26, 2001

(54) FIELD EMISSION DISPLAY WITH SUSPENDED FOCUSING CONDUCTIVE SHEET

(75) Inventors: R. Dennis Breen, Groton; Seth A. Berman, Marblehead; Thomas A. Roach, West Wareham, all of MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 08/586,100

(22) Filed: Jan. 16, 1996

(51) Int. Cl.[7] ..... H01J 1/62

(52) U.S. Cl. ..... 313/495; 313/309; 313/310; 313/336; 313/351

(58) Field of Search ..... 313/495, 309, 313/310, 336, 351

(56) References Cited

U.S. PATENT DOCUMENTS

| | | | |
|---|---|---|---|
| 4,513,308 | 4/1985 | Greene et al. | 357/55 |
| 4,663,559 | 5/1987 | Christensen | 313/336 |
| 4,740,705 | 4/1988 | Crewe | 250/423 E |
| 4,857,161 | 8/1989 | Borel et al. | 204/192.26 |
| 4,908,539 | 3/1990 | Meyer | 315/169.3 |
| 4,940,916 | 7/1990 | Borel et al. | 313/306 |
| 5,012,153 | 4/1991 | Atkinson et al. | 313/351 |
| 5,012,482 | 4/1991 | Gray | 372/74 |
| 5,030,895 | 7/1991 | Gray | 315/350 |
| 5,032,832 | 7/1991 | Clerc et al. | 340/805 |
| 5,045,754 | 9/1991 | Clerc | 313/495 |
| 5,057,047 | 10/1991 | Greene et al. | 445/24 |
| 5,064,396 | 11/1991 | Spindt | 445/50 |
| 5,075,683 | 12/1991 | Ghis | 340/793 |
| 5,103,144 | 4/1992 | Dunham | 315/366 |
| 5,103,145 | 4/1992 | Doran | 313/309 |
| 5,138,308 | 8/1992 | Clerc et al. | 340/758 |

(List continued on next page.)

OTHER PUBLICATIONS

Field Emission Displays–A 10,000 fL High–Efficiency Field Emission Display by Alan Palevsky, Gordon Gammie and P. Koufopoulos Society for Information Displays, San Jose, CA, pp. 12–17 Jun. 1994.

*Primary Examiner*—Vip Patel
(74) *Attorney, Agent, or Firm*—Daly, Crowley & Mofford, LLP

(57) ABSTRACT

A field emission display having a focusing grid disposed between the anode and a plurality of cathodes. The focusing grid comprises a conductive sheet having an array of apertures formed therein. Each one of the cathodes comprises a set of field emitters. Each aperture is associated with a corresponding set of field emitters. The conductive sheet is disposed over the corresponding set of field emitters. The sheet is supported at the periphery thereof by a frame with the interior portion of the sheet suspended in tension by the frame thereby supporting the grid substantially equidistant over the sets of field emitters. A method is provided for supporting the sheet in tension by the frame includes the steps of providing a clamp having a pair of apertured members. A first member has a groove disposed about the periphery of such member. A ring member is provided. A focusing grid, comprising an apertured, conductive sheet, has the peripheral portion thereof disposed between the groove formed in the first clamp member and the ring. The second clamp member is placed over the ring. A force is exerted to the clamp members and the ring onto the peripheral portion of the sheet, the ring urging the sheet into the groove while the periphery of the sheet is fixed to the clamp to stretch the inner region of the sheet to a predetermined tensional force. The tensioned focusing grid is then affixed to a frame by first applying a force to a resilient wall of the frame to deflect the wall inwardly, placing a peripheral portion of the sheet onto the deflected wall, affixing the placed sheet onto the deflected wall, and after such affixation, removing the applied force.

19 Claims, 6 Drawing Sheets

U.S. PATENT DOCUMENTS

| | | | |
|---|---|---|---|
| 5,191,217 | 3/1993 | Kane et al. | 250/423 |
| 5,194,780 | 3/1993 | Meyer | 315/169 |
| 5,214,345 | 5/1993 | Gray | 313/355 |
| 5,225,820 | 7/1993 | Clerc | 340/752 |
| 5,231,387 | 7/1993 | Clerc | 340/781 |
| 5,231,606 | 7/1993 | Gray | 365/226.6 |
| 5,262,698 | 11/1993 | Dunham | 315/169.4 |
| 5,278,544 | 1/1994 | Leroux | 345/74 |
| 5,347,292 | 9/1994 | Ge et al. | 345/74 |
| 5,359,256 | 10/1994 | Gray | 313/169 |
| 5,602,443 * | 2/1997 | Igeta et al. | 313/495 |
| 5,977,693 * | 11/1999 | Nakamoto et al. | 313/309 |

* cited by examiner

FIELD EMISSION DISPLAY WITH SUSPENDED FOCUSING CONDUCTIVE SHEET

BACKGROUND OF THE INVENTION

This invention relates generally to field emission displays and manufacturing methods, and more particularly to field emission displays having focusing grids.

As is known in the art, field emission displays (FEDS) include an array of field emitting cathodes, a cathodoluminescent anode, and an array of control electrodes. Each one of the control electrodes is associated with a corresponding display pixel and controls the flow of electrons between the cathodes and the corresponding anode pixel. In a monochromatic array, each pixel corresponds to either a so-called "black" or "white" display luminescence; in a color display each pixel corresponds to a luminous blend of a plurality of, typically three colors.

In order to achieve a relatively bright display, (i.e., up to the order of 10,000 foot lamberts) with typical cathodoluminescent efficiencies, a voltage in the order of 10,000 volts is required between the cathode and anode. In order to reduce the effect of electron beam spreading and its concomitant reduction in picture resolution, cathode to anode separations of less than 3–4 millimeters are required. However, in order to prevent arcing between the anode and cathode with 10,000 volts therebetween, an anode to cathode separation in the order of 3–4 millimeters, or greater, is required. Thus, a compromise must be made between resolution and brightness.

SUMMARY OF THE INVENTION

In accordance with the present invention, a field emission display is provided having a plurality of cathodes; a cathodoluminescent anode; a plurality of control electrodes for controlling the flow of electrons between the cathodes and the anode; and a focusing grid, comprising an apertured, conductive sheet, supported in tension over the cathodes.

With such an arrangement, the focusing grid is supported substantially equidistant over the cathodes.

In accordance with another feature of the invention, the emission display including a frame and an apertured, conductive sheet having an array of apertures formed in an interior region thereof and affixed thereto to provide the focusing grid. The conductive sheet is supported at the periphery thereof by the frame with the interior portion of the conductive sheet being suspended in tension by the frame. The apertured, conductive sheet and the affixed frame provide a focusing grid assembly.

In a preferred embodiment, the field emission display includes a plurality of cathodes, an anode, a plurality of control electrodes for controlling the flow of electrons between the cathodes and the anode, and a focusing grid, comprising an apertured, conductive sheet, disposed between the anode and the plurality of cathodes. Each one of the cathodes comprises a set of field emitters. Each aperture is associated with a corresponding set of field emitters. Each aperture is disposed over the corresponding set of field emitters. The apertured, conductive sheet is supported at the periphery thereof by a frame with the interior portion of the apertured, conductive sheet suspended in tension by the frame. The apertured, conductive sheet and attached frame provide a focusing grid assembly.

In accordance with another feature of the invention, a method is provided for providing a focusing grid, comprising an apertured, conductive sheet for disposition over an array of field emitters. The method includes the steps of: providing a frame; affixing the apertured, conductive sheet to the frame while such apertured, conductive sheet is in tension; and, mounting the frame, with the tensioned, apertured, conductive sheet affixed thereto, over the array of field emitters.

In a preferred embodiment, the focusing grid is formed as a conductive sheet with the apertures formed in an interior region of the conductive sheet. A force is provided to the apertured, conductive sheet in a direction from the interior region of the sheet to an outer region to stretch the sheet into tension. With such force applied to the sheet, the sheet is affixed to the frame.

In accordance with an another feature of the invention, a method is provided for providing a focusing grid, comprising an apertured, conductive sheet, over an array of field emitters. The method includes the steps of: providing a frame; affixing the apertured, conductive sheet in tension to the frame; providing an inwardly directed force to a wall of the frame; affixing the tensioned apertured, conductive sheet to the frame when the frame has the force provided to the wall; and, mounting the frame, with the sheet affixed thereto, over the array of field emitters.

In a preferred embodiment of the invention, the method includes the steps of providing a pair of members, such pair of members providing a clamp, a first one of such members having a groove formed therein. A ring member is provided. A conductive sheet, having an array of apertures formed in an inner region thereof, has the peripheral portion thereof disposed between the groove formed in the first one of the pair of clamp members and the ring. The second one of the clamp members is placed over the ring. A force is exerted to the clamp members and, through the ring, to the sheet, the ring urging the sheet into the groove while the periphery of the sheet is fixed to the clamp to stretch the inner region of the sheet to a predetermined tensional force. The tensioned, apertured conductive sheet providing the focusing grid is then affixed to a frame.

In accordance with another feature of the invention, a method for affixing a focusing grid, comprising an apertured, conductive sheet, to a frame is provided. The method includes providing the tensioned, conductive sheet. Forcing a resilient wall of the frame to deflect the wall inwardly, placing a peripheral portion of the tensioned, apertured conductive sheet onto the deflected wall, affixing the placed sheet onto the deflected wall, and after such affixation, removing the applied force. With such arrangement, the resilient wall maintains its tension across the inner region of the sheet.

BRIEF DESCRIPTION OF THE DRAWING

FIG. 5A showing the sheet prior to being placed in tension, and FIG. 5B showing the sheet after having been placed in tension;

FIGS. 6A, 6B and 6C showing the frame in an un-tensioned condition prior to the affixation between the tensioned frame and the tensioned sheet and FIGS. 7A, 7B and 7C showing the frame in a pre-loaded condition; FIG. 6A being a plan sketch, FIG. 6B being a plan sketch of the region enclosed by line 6B—6B in FIG. 6A, FIG. 6C being a cross sectional sketch of FIG. 6B; FIG. 7A being a plan sketch, FIG. 7B being a plan sketch of the region enclosed by line 7B—7B in FIG. 7A, and FIG. 7C being a cross sectional sketch of FIG. 7B;

DESCRIPTION OF THE PREFERRED EMBODIMENTS

Figure 1:
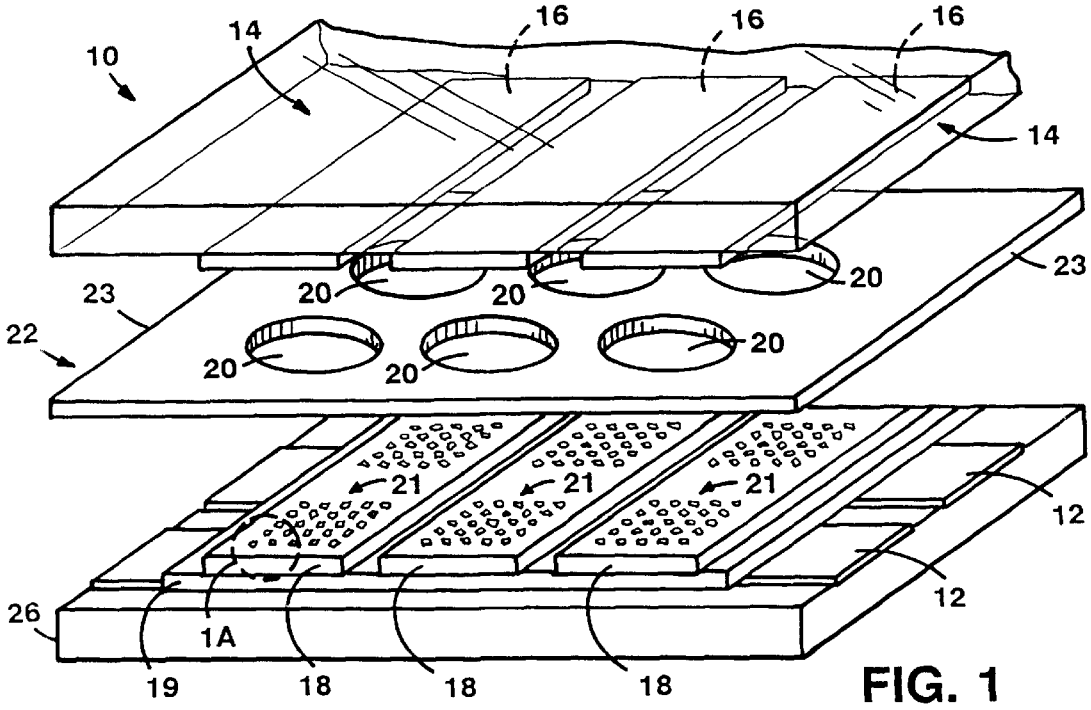
FIG. 1 is an isometric sketch of a field emission display according to the invention, a portion of field emitters thereof being shown in an enlarged view.
Figure 1A:
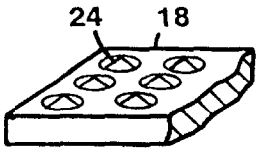
FIG. 1A is an enlarged view of a portion of the display of FIG. 1, such portion being enclosed by dotted lines in FIG. 1.
Figure 2:
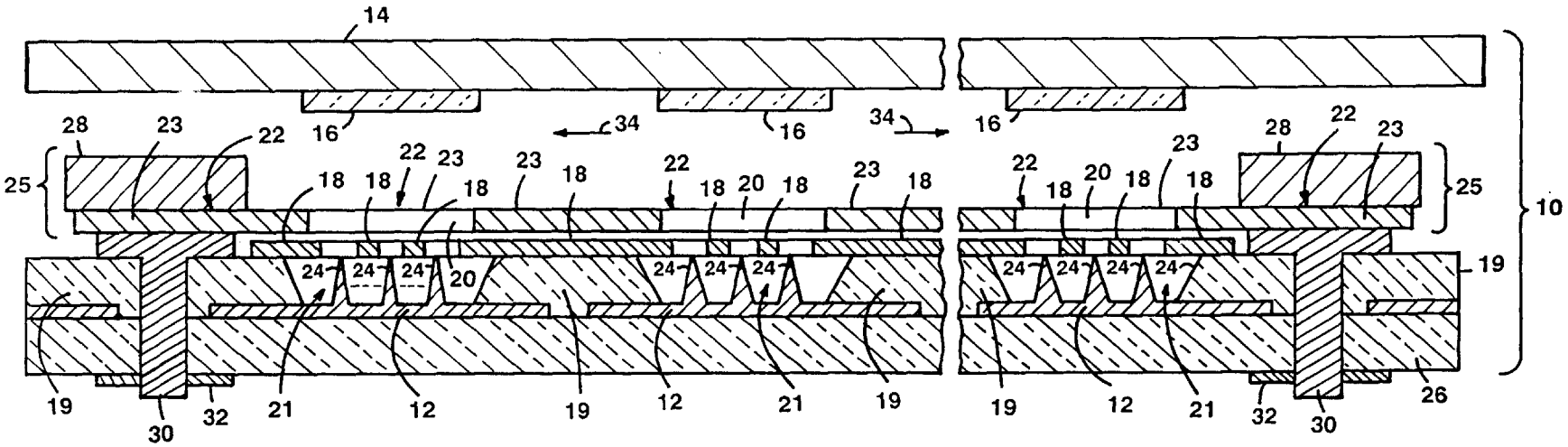
FIG. 2 is a cross-section, diagrammatical sketch of the field emission display of FIG. 1.

Referring now to FIGS. 1, 1A and 2, a field emission display 10 is shown having: a plurality of cathodes 12, a anode 14 having a plurality of cathodoluminescent dots or stripes 16; a plurality of control electrodes 18 for controlling the flow of electrons between the cathodes 12 and the anode 14; and a focusing grid assembly 25. The focusing grid assembly 25 comprises: a frame 28; and, a focusing grid 22 affixed to the frame 28. The focusing grid 22 comprises an apertured, conductive sheet 23, affixed to frame 28, and disposed between the anode 14 and the plurality of cathodes 12. Each cathodoluminescent dot or stripe 16 may be a different one of three colors, as in a color display, or may be the same color, as in a monochromatic display. Each one of the cathodes 12 comprises a plurality of sets 21 of field emitters 24.

As noted above, the focusing grid 22 comprises an apertured conductive sheet 23. More particularly, the focusing grid 22 includes a conductive sheet 23 having a plurality of apertures 20 formed therein and arranged in an array in the central, interior region of the sheet 23. Each aperture 20 is associated with a corresponding one of the sets 21 of the plurality of field emitters 24. More particularly, each one of the apertures 20 is disposed over the corresponding set of field emitters 24.

The focusing grid 22 is disposed between one of the cathodoluminescent stripes 16 and a set 21 of the field emitters 24. The focusing grid 22 is biased at a voltage greater than the voltage of the field emitters 24 and less than the anode 14. The focusing grid 22 intercepts any very high angle electrons thereby preventing them from getting to the anode 14, focuses the electrons that are not intercepted to a more localized, i.e., focused region on the anode 14, and, because the electric field in the space between the cathode 12 and the focusing grid 22 is less than the electric field between the focusing grid 22 and the anode 14, the focusing grid 22 increases the shielding, or isolation, between the cathode 12 from the high voltage anode 14, as described in co-pending patent application Ser. No. 08/439,391, now U.S. Pat. No. 5,545,691, entitled "Field Emission Display with Focus Grid and Method of Operating Same", inventors Alan Palevsky and Peter F. Koufopoulos, filed May 11, 1995, assigned to the same assignee as the present invention, the subject matter thereof being incorporated herein by reference.

The cathodes 12 are disposed on an insulating substrate 26, here glass. The control electrodes 18 are formed on a layer 19 of insulating material. The outer periphery of apertured conductive sheet 23 is welded to frame 28 in a manner to be described in detail hereinafter, to provide the focusing grid assembly 25 (FIG. 2). Suffice it to say here, however, that the frame 28, with the sheet 23 welded to it, are supported on a stand-off 30 having legs which pass through the glass substrate 26. The stand-off 30 is welded to a support ring 32 on the bottom surface of the substrate 26, as shown. As will also be described in detail hereinafter, the sheet 23 is supported at the periphery thereof by the frame 28 with the interior portion of the sheet 23 being suspended in tension by the frame 28 over the field emitters 24. That is, the sheet 23 has tensile forces in radial directions outward from its central interior region (i.e., the tensile forces are in the direction indicated by arrows 34). It is noted that, the interior portion of sheet 23 moves outward relative to its fixed outer peripheral portion.

These tensile forces are imparted to the sheet 23 in a manner to be described and are maintained by the frame 28 after attachment to the frame 28, in a manner to be described. Thus, the focusing grid 22, because of the tensile forces provided in the apertured, conductive sheet providing such focusing grid 22 (and maintained in tension by the frame 28), is supported substantially equidistant over the sets 21 of field emitters 24 throughout its entire span across the frame 28 and therefore throughout its entire span across the sets 21 of field emitters 24.

Figure 3:
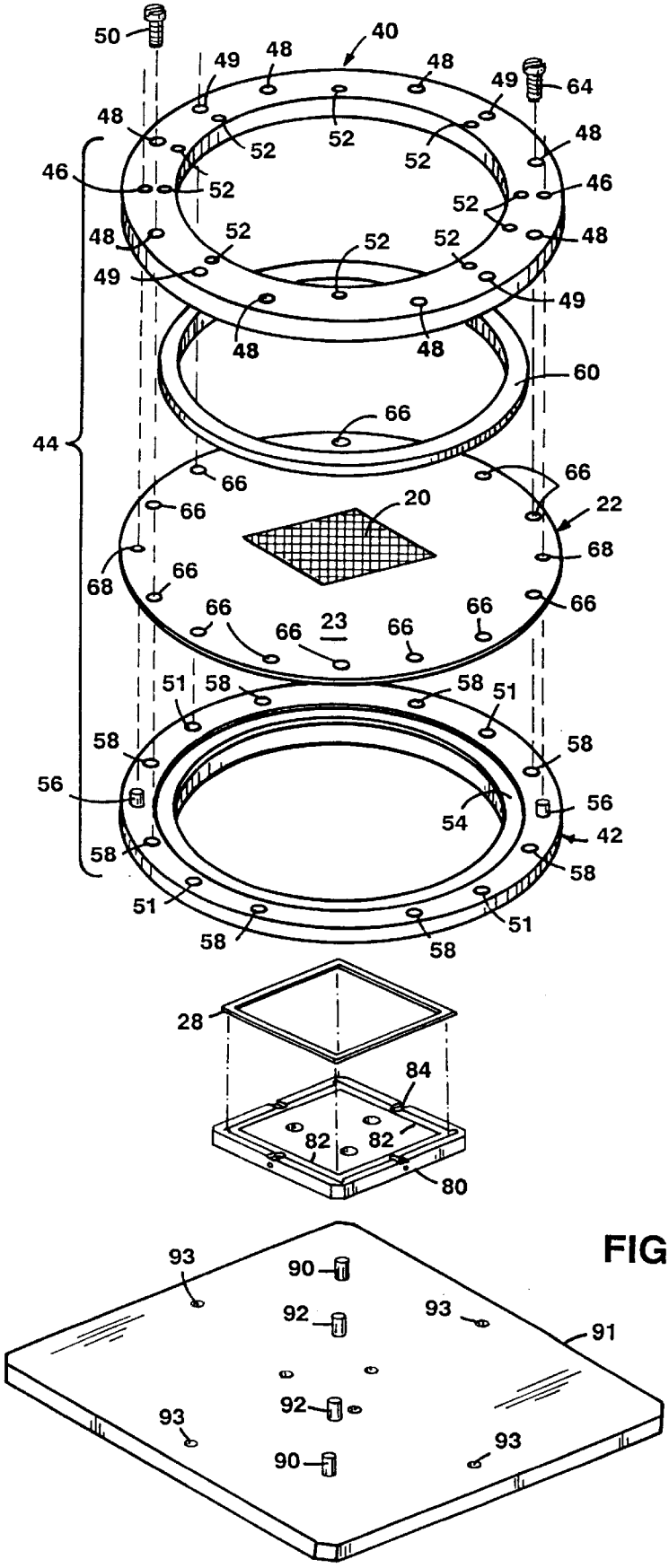
FIG. 3 is an isometric, exploded diagrammatical sketch of apparatus used to tension a focusing grid used in the field emission display of FIG. 1.
Figure 4:
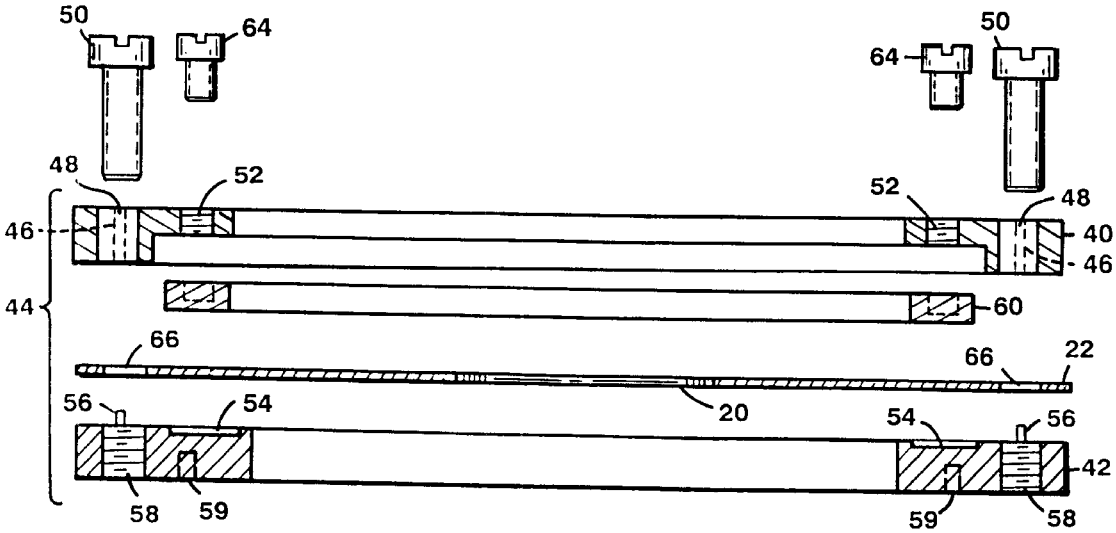
FIG. 4 is a cross-sectional, exploded diagrammatical sketch of apparatus used to form the focusing grid used in the field emission display of FIG. 1.

Referring now to FIGS. 3 and 4, the method for supporting the sheet 23 in tension within frame 28 is described. More particularly, a pair of steel or aluminum, for example, apertured, ring shaped, members 40, 42 is provided. As will be described, the pair of members 40, 42 provide a clamp 44. A first one of such members 40, 42, here member 40, has four sets of holes formed through it. The first set is a pair of alignment holes 46. The second set is eight, non-threaded holes 48 dimensioned to pass therethrough eight screws 50 (FIG. 3). The third set is a set of four non-threaded holes 49. The first, second and third sets of holes 46, 48, 49 are disposed along an outer circumferential periphery of member 40, as shown more clearly in FIG. 3. The fourth set is the, threaded, holes 52 are regularly spaced about the inner circumferential periphery of member 40.

Member 42 has a groove 54 machined about its inner periphery. The member 42 has a pair of alignment pegs 56 projecting, here upwardly, from it. The pegs 56 are adapted for insertion through, or into, alignment holes 46 of member 40. The member 42 also has eight threaded holes 58 formed in it adapted to receive screws 50. The member 42 has four non-threaded holes 51 aligned with holes 49 of member 40. A pair of alignment holes 59 are also formed in the bottom of member 42 (FIG. 4).

A steel, annular, force applying ring member 60 has an outer diameter dimensioned so that the ring may be inserted onto, and thereby rest on, the groove 54 of member 42.

The conductive sheet 23 has an array of the apertures 20 formed in an inner region of the sheet 23, as shown. The outer periphery of the sheet 23 has a plurality of here fourteen holes 66 formed through it. Here, the sheet 23 has a diameter of 10.65 inches and disposed centrally therein, a four inch by four inch array of photolithographic-chemical etched apertures 20. Here, the sheet 23 has a thickness of 3 mils and is a 48% nickel and 52% iron alloy material sold by Ametek, Wallingford, Conn. as Alloy 948 material.

Figure 5A:
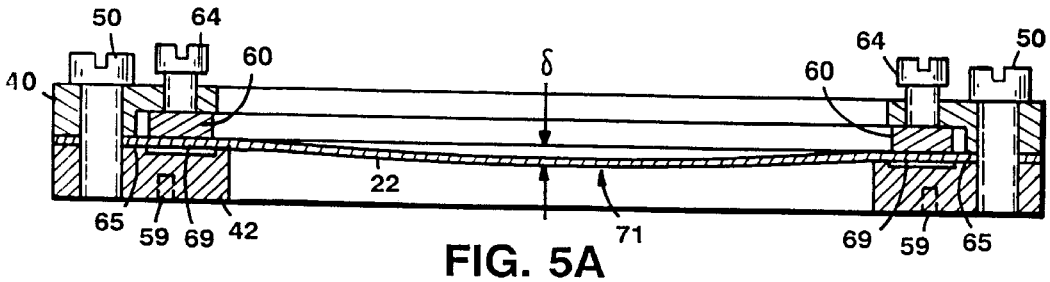
FIGS. 5A and 5B are cross-sectional diagrammatical sketches useful in understanding the method of placing an apertured, conductive sheet providing the focusing grid in tension.
Figure 5B:
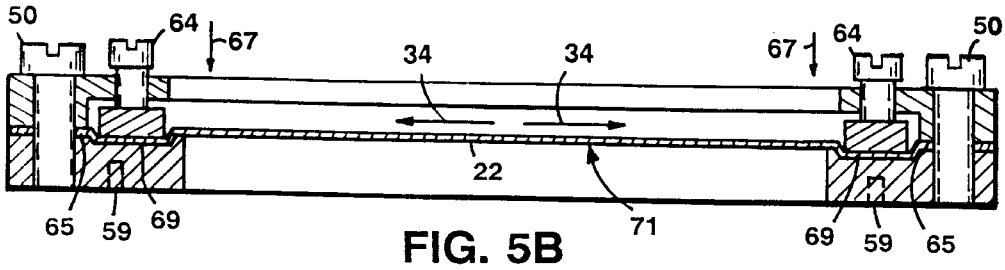

First, the peripheral portion of the sheet 23 is disposed between the groove 54 in member 42 and the ring 60, as shown in FIG. 3. More particularly, alignment holes 68 in sheet 23 are placed over pegs 56 in member 42. Next, ring 60 is placed on groove 54. Next, member 40 is placed over the ring 60, as shown in FIG. 4. It is noted that the alignment pegs 56 pass through holes 68 and 46. It is also noted that holes 48, 49, 51, 68 and 58 are all mutually aligned. Next, the members 40, 42 are fastened together tightly by screws 50. After the members 40, 42 are fasten together, they securely fixed between them the outer peripheral portion 65 of sheet 23. A force is exerted to the ring member 60 by tightening down on screws 64, as shown in FIG. 5B. This force on ring member 60 urges portion 69 of the sheet 23 into the groove 54 and thereby stretches the central inner region 71 of the sheet 23 outward to thereby provide a predetermined radially outward tensional force on sheet 23.

More particularly, screws 50 passed through holes 48 formed through member 40, then through the holes 66 formed through the sheet 23, and are then threaded into holes 58 formed in member 42 to thereby clamp, or lock, the outer periphery 65 of the sheet 23 between the pair of clamp members 40, 42. It should be noted that at this time, the ring member 60 is able to move up and down between the pair of clamping members 40, 42. It is also noted that the central, inner region 71 of the sheet 23 is not under tension and therefore sags under its own weight, here an amount, δ, as shown in FIG. 5A.

Next, screws 64 are threaded into holes 52 formed in clamp member 40. As the screws 64 are threaded, the ring member 60 is driven here downwardly as indicated by arrows 67 against an inner portion 69 of the outer periphery of the sheet 23. Therefore, because the outer portion 65 of the outer periphery of the sheet 23 is locked by the pair of clamping members 40, 42, the force provided by screws 64 driving the ring against the inner portion 69 of the outer periphery of the sheet 23 into the groove 54 stretches the sheet 23 radially outwardly from its inner region 71 as indicated by the arrows 34. As the screws 64 are threaded into clamp member 40, the tension across the sheet 23 is measured. Typically, the process continues until the tension increases in the order 1 to 20 percent of the elastic yield strength of sheet 23.

Next, the tensioned sheet 23 is affixed, here by seam welding, to frame 28 (FIG. 3). First, the frame 28 is provided. The frame 28 is of the same material as sheet 23, both being thermally matched to glass substrate 26. Here the thickness of the frame 28 is 0.075 inches and the width is ¼ inch. It has been found that if the tensioned sheet 23 was directly welded to the frame 28, being somewhat resilient, bent inwardly somewhat in response to the tension of the sheet 23 and thereby removed the tension on the sheet 23 after the sheet 23 was welded to the frame 28. The result was that the sheet 23, after being affixed to the frame 28, suffered from relaxation in tension in its inner region 71 due to frame flexture (FIG. 5A).

In order to prevent this loss of tension in sheet 23, the frame 28 is first placed in a frame fixture 80. The frame fixture 80 has a recess 82 to receive the frame 28. About the periphery of the recess 82 are a plurality of force applying mechanisms, here eccentric cam-like actuators 84 mounted to each wall of the fixture 80 are rotated sufficiently to force the walls of the frame 28 inwardly in a precise manner thereby placing the frame 28 in an inwardly bent, compressed, pre-loaded, condition. Once the walls of frame 28 are pre-loaded, the tensioned sheet 23 is positioned over the pre-loaded frame 28 bringing the taut, or tensioned sheet 23 into intimate contact with the pre-tensioned frame 28. Once in contact, the sheet 23 is permanently affixed to the frame 28, here by seam welding. Once permanently affixed to the frame 28, the portions of the sheet 23 extending beyond the frame 28 are removed by any suitable cutting process. Edges of the sheet 23 are then rolled over the rounded edges 99 of the edge rounded frame 28 and seam welded to provide a smooth, continuous surface.

Thus, by applying a force to the resilient walls of the frame 28 and thereby deflecting such walls inwardly, placing a peripheral portion of the sheet 23 onto the deflected wall, affixing the placed sheet 23 onto the deflected wall, and after such affixation, removing the applied force, any tendency of the resilient walls to return somewhat because of the tension of the attached sheet 23 will still result again act to again force the sheet outward and the sheet will remain in a tensioned condition. That is, after affixation, the resilient wall maintains any tension across the inner region of the sheet provided by the aforementioned process.

Figure 6A:
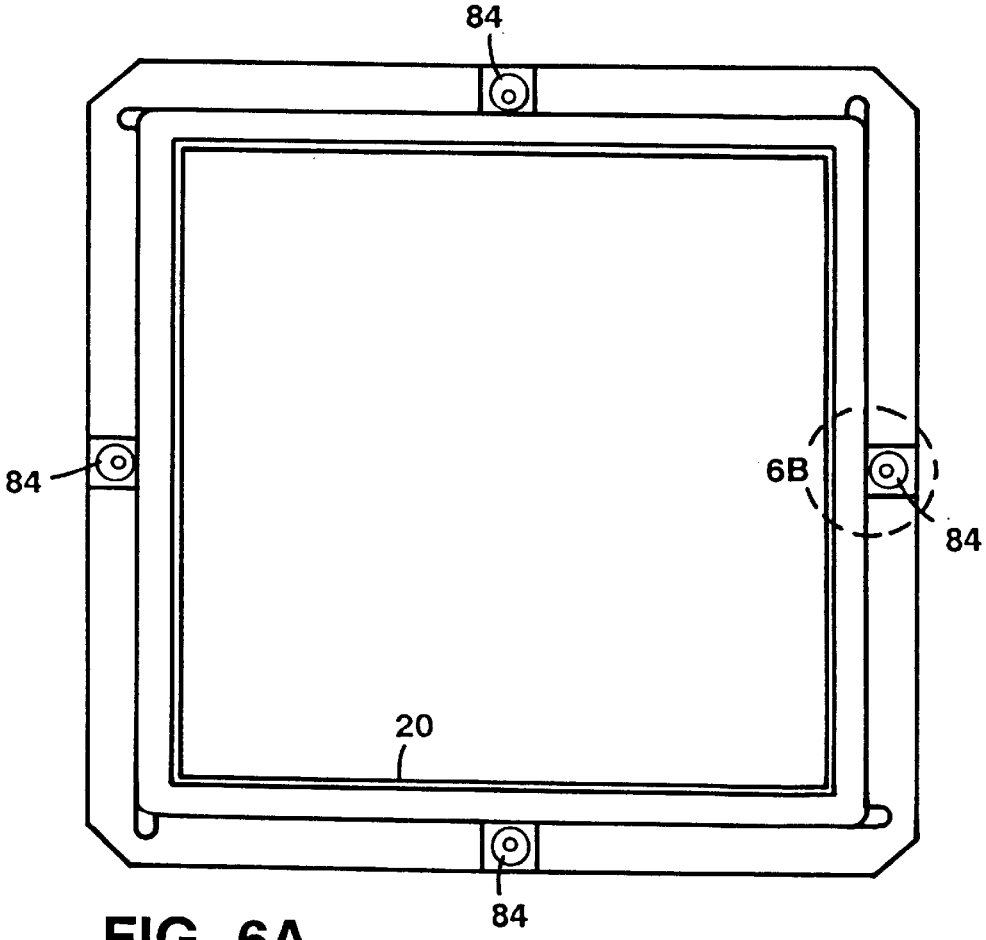
FIGS. 6A–6C and 7A–7C are sketches useful in understanding the method of affixing the tensioned sheet in FIG. 5B to a frame.
Figure 6B:
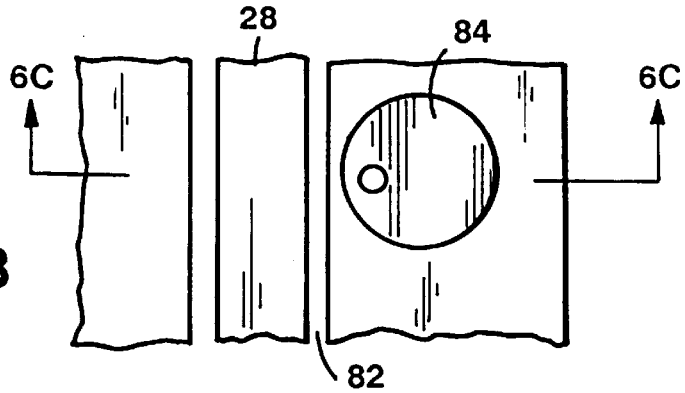
Figure 6C:
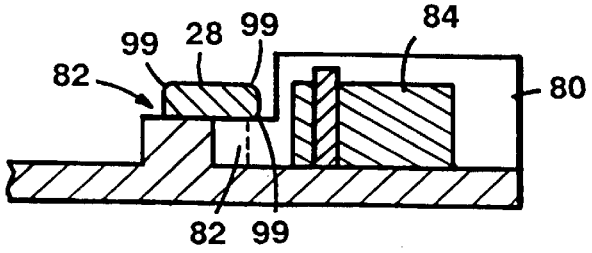
Figure 7A:
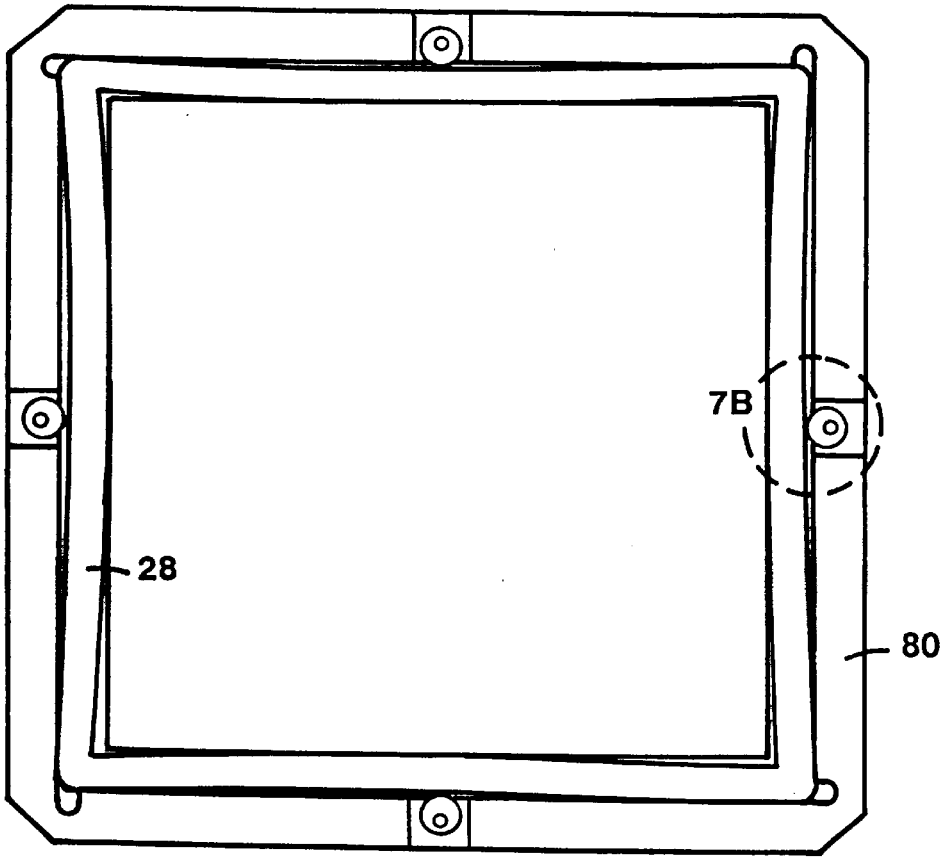
Figure 7B:
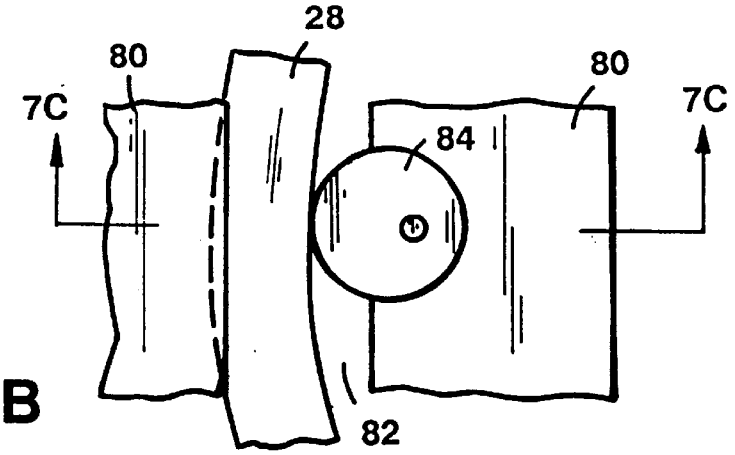
Figure 7C:
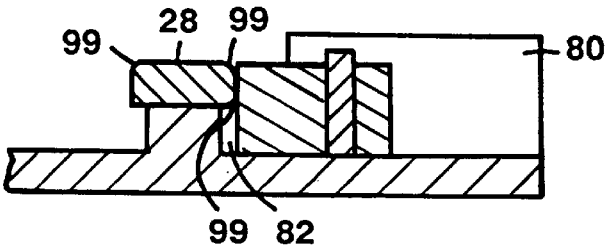

More particularly, first the span across opposing walls of the frame 28 is measured. Next, the frame 28 is placed in the fixture 80, as shown in FIGS. 6A, 6B and 6C. The cams 84 are rotated to deflect the opposing walls of the frame 28 inwardly, as shown in FIGS. 7A, 7B and 7C and the span across such opposing walls is measured. The process continues until a predetermined deflection is reached. For example, here until a deflection of about 6 mils is reached. Such deflection was found adequate to counter-balance any force provided on the walls of the frame 28 by the tensioned sheet 23.

Figure 8:
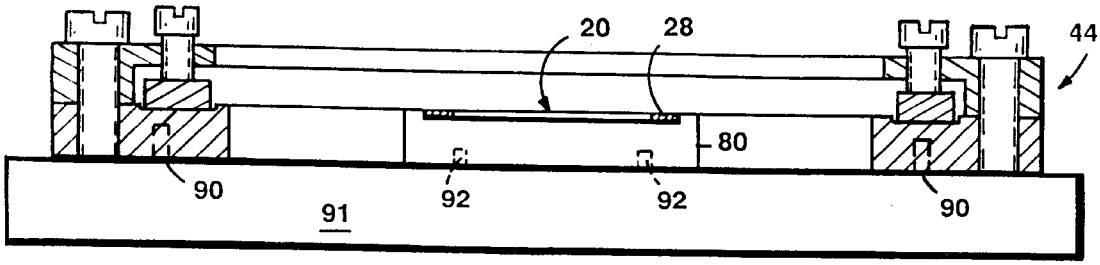
FIG. 8 is a cross-sectional elevation sketch showing the arrangement between the tensioned sheet and the tensioned frame as the two are affixed together.

Completing the fabrication process, the sheet 23, which is clamped in tension between the clamping members 40, 42 is placed over the pre-tensioned frame with the array of apertures formed in sheet 23 over the region of the frame 28 bordered by the walls of frame 28, as shown in FIG. 8. Referring also to FIG. 3, a base plate 91 is used to register, via locator pins 90, the clamp 44 by inserting such locator pins 90 into holes 59 of member 42 (FIG. 4). Likewise, alignment pins 92 in base plate 91 are used to locate fixture 80 which has holes in the bottom thereof to receive the alignment pins 92. Thus, the alignment pins 92 used to provide for proper registration between the focusing grids 20 and the frame 28, as shown in FIG. 8.

Figure 9:
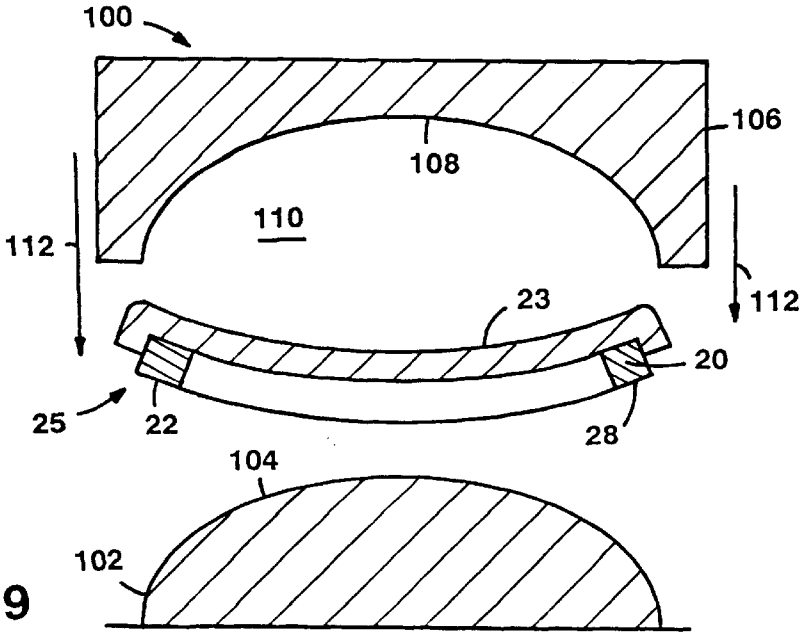
FIG. 9 is a diagram showing a reverse roll process used in the method according to the invention.

More particularly, fixture 80 is set onto pins 92. The clamp 44 is set over the pins 90. The aperture in member 42 allows the interior region of the sheet 23 to come into contact with frame 28. Screws, not shown, are fastened into threaded holes 93 after passing through holes 49 and 51 to fasten the clamp to base 91. The sheet 23 is then seam welded to the frame 28 through the top of the clamp 44, i.e., by the exposure provided to the welding apparatus, not shown, by the aperture in member 42. Once welded to the frame 28, the cams 84 are rotated back to their original orientation. The frame 28 is then removed from the fixture 28. Once removed, the peripheral portions of the sheet 23 extending beyond the frame are removed by any cutting process. Edges of the sheet 28 which remain after cutting are then rolled over the edge 99 radius of the frame 28 and seam welder to facilitate a smooth burr free edge, as discussed above. The focus grid assembly 25, i.e., the frame 28 with the screen 23 affixed thereto, i.e, the focusing grid assembly 25, will now have a bow in it, as shown in FIG. 9, due to eccentricity of the tensile force. The assembly 25 is then placed in a fixture 100 shown in FIG. 9, to straighten the assembly 25 to a flat condition (i.e., here to a flatness within 3 mils) using a reverse roll process. Thus, the lower portion 102 of fixture 100 has its upper face 104 convex and the upper portion 106 of fixture 100 has a lower face 108 concave. The assembly 25 is inserted into the region 110 between faces 104, 108, in the bowed up position, as shown. The faces 104, 108 are brought together, as indicated by the arrows 112 to provide the reverse roll process to the assembly 25.

Finally, the frame assembly 25, with the tensioned sheet affixed thereto is affixed to stand-off 30 over the array of field emitters, as shown in FIG. 2.

Other embodiments are within the spirit and scope of the appended claims. For example, while the frame pre-tensioning is performed by applying force at a single point on each wall of the frame, a force need only be applied to one of each pair of opposing walls of the frame. Alternatively, a distribution of forces may be applied to any opposing wall of the frame where more accurate pre-tension bending of the frame is required Further, while one sheet 23 has been described, multiple sheets, after optical registration, may be welded together to increase the effective thickness of the focussing grid.

What is claimed is:

1. A field emission display, comprising:

a plurality of cathodes;

an anode;

a plurality of control electrodes for controlling the flow of electrons between the cathodes and the anode; and a conductive sheet having a plurality of apertures formed therein, each one of the apertures being disposed over a corresponding one of the cathodes, the sheet being supported in tension over the cathodes.

2. The field emission display recited in claim 1 including a frame, the sheet being supported at the periphery thereof by the frame with the interior portion of the sheet being suspended in tension by the frame.

3. A field emission display, comprising:

a plurality of cathodes;

a cathodoluminescent anode;

a plurality of control electrodes for controlling the flow of electrons between the cathodes and the anode; and a focusing grid, comprising a conductive sheet having a plurality of apertures formed therein and disposed between the anode and the plurality of cathodes, each one of the cathodes comprising a set of field emitters, each one of the apertures being associated with a corresponding set of field emitters, each aperture being disposed over the corresponding set of field emitters, the sheet being supported in tension over the field emitters.

4. A field emission display, comprising:

a plurality of cathodes;

an anode;

a plurality of control electrodes for controlling the flow of electrons between the cathodes and the anode; and a focusing grid, comprising a conductive sheet having a plurality of apertures formed therein, disposed between the anode and the plurality of cathodes, each one of the cathodes comprises a set of field emitters, each aperture being associated with a corresponding set of field emitters, each aperture having being disposed over the corresponding set of field emitters;

a frame, the sheet being supported at the periphery thereof by the frame with the interior portion of the sheet suspended in tension by the frame.

5. The display recited in claim 4 wherein the focusing grid is supported substantially equidistant over the sets of field emitters.

6. The display recited in claim 4 wherein the focusing grid comprises a plurality of apertured, conductive sheets.

7. The display recited in claim 6 wherein the focusing grid is arranged and configured to intercept a portion of dispersed electrodes thereby preventing them from getting to the anode, focus non-intercepted electrons to a region on the anode, and, a provide a degree of shielding between the cathode from the high voltage anode.

8. A method for providing a focusing grid, comprising a conductive sheet having a plurality of apertures formed therein, over an array of field emitters comprising the steps of:

providing a frame;

affixing the conductive sheet onto the frame while such sheet is in tension; and mounting the frame with the tensioned sheet affixed thereto over the array of field emitters.

9. The method recited in claim 8 wherein the plurality of apertures is formed in an interior region of the conductive sheet, and including the step of applying a force in a direction from the interior region of the sheet to a outer region to place the sheet in tension.

10. The method recited in claim 9 including the step of affixing the sheet to the frame with the force applied to the sheet.

11. A method for providing a focusing grid, comprising an apertured conductive sheet, over an array of field emitters, comprising the steps of:

providing a frame;

mounting the apertured, conductive sheet, in tension onto the frame;

providing a inwardly directed force to a wall of the frame;

affixing the tensioned sheet to the frame with such frame having the force provided to the wall; and, mounting the frame over the array of field emitters.

12. A method for affixing a sheet in tension to a frame, comprising:

providing a pair of members, such pair of members providing a clamp, a first one of such members having a groove therein;

providing a ring member;

providing a conductive sheet having an array of apertures formed in an inner region of the sheet, the peripheral portion thereof being disposed between the groove formed in the first one of the pair of clamp members and the ring;

placing the second one of the clamp members over the ring;

exerting a force to the clamp members, and through the ring onto the peripheral portion of the sheet, the ring urging the sheet into the groove while the periphery of the sheet is fixed to the clamp to stretch the inner region of the sheet to a predetermined tensile force; and affixing the tensioned focusing grid sheet to the frame.

13. The method recited in claim 12 including the steps of:

applying a force to a resilient wall of the frame to deflect the wall inwardly;

placing a peripheral portion of the sheet onto the deflected wall and with the array of apertures over a region of the frame bordered by the walls of the frame;

affixing the placed sheet onto the deflected wall and with the array of apertures over a region of the frame bordered by the walls of the frame; and after such affixation, removing the applied force.

14. A method for affixing a sheet in tension to a frame, comprising:

providing a pair of apertured members, such pair of members providing a clamp, a first one of such members having a groove disposed about the periphery of such member;

providing a ring member;

providing a conductive sheet having an array of apertures formed in an inner region of the sheet, the peripheral portion thereof being disposed between the groove formed in the first one of the pair of clamp members and the ring;

placing the second one of the clamp members over the ring;

exerting a force to the clamp members, and through the ring onto the peripheral portion of the sheet, the ring urging the sheet into the groove while the periphery is fixed to the clamp to stretch the inner region of the sheet to a predetermined tensile force; and affixing the tensioned focusing grid sheet to the frame.

15. The method recited in claim 14 including the steps of:

applying a force to a resilient wall of the frame to deflect the wall inwardly;

placing a peripheral portion of the sheet onto the deflected wall and with the array of apertures over a region of the frame bordered by the walls of the frame;

affixing the placed sheet onto the deflected wall and with the array of apertures over a region of the frame bordered by the walls of the frame; and after such affixation, removing the applied force.

16. A method of providing a field emission display, comprising: a plurality of cathodes; an anode; a plurality of control electrodes for controlling the flow of electrons between the cathodes and the anode; and a sheet having a plurality of apertures formed therein, such sheet being disposed between the anode and the plurality of cathodes, comprising the steps of:

providing a pair of members, such pair of members providing a clamp, a first one of such members having a groove disposed about the periphery of such member;

providing a ring member;

providing the conductive sheet having the array of apertures therein, the peripheral portion thereof being disposed between the groove formed in the first one of the pair of clamp members and the ring;

placing the second one of the clamp members over the ring;

exerting a force to the clamp members, and through the ring to the peripheral portion of the sheet, such ring urging the sheet into the groove while the periphery is fixed to the clamp members to stretch the inner region of the sheet to a predetermined tensile force; and affixing the tensioned focusing grid sheet to the frame.

17. The method recited in claim 16 wherein the members are formed as apertured members.

18. The method recited in claim 17 including the steps of:

applying a forcing to a resilient wall of the frame to deflect the wall inwardly;

placing a peripheral portion of the sheet onto the deflected wall and with the array of apertures over a region of the frame bordered by the walls of the frame;

affixing the placed sheet onto the deflected wall and with the array of apertures over a region of the frame bordered by the walls of the frame; and after such affixation, removing the applied force.

19. A method of providing a field emission display, comprising: a plurality of cathodes; a cathodoluminescent anode; a plurality of control electrodes for controlling the flow of electrons between the cathodes and the anode; and a plurality of focusing grids, disposed between the anode and the plurality of cathodes, each one of the cathodes comprising a set of field emitters, each focusing grid being associated with a corresponding set of field emitters, the plurality of focusing grids comprising an apertured conductive sheet, each aperture having being disposed over the corresponding set of field emitters, comprising the steps of:

providing a pair of members, such pair of members providing a clamp, a first one of such members having a groove disposed about the periphery of such member;

providing a ring member;

providing the conductive sheet with the array of apertures formed in the inner region of the sheet, the peripheral portion thereof being disposed between the groove formed in the first one of the pair of clamp members and the ring;

placing the second one of the clamp members over the ring;

exerting a force to the clamp members, and through the ring onto the peripheral portion of the sheet, such ring urging the sheet into the groove while the periphery is fixed to the clamp members to stretch the inner region of the sheet to a predetermined tensile force; and affixing the tensioned focusing grid sheet to the frame.

* * * * *